US010500111B1

(12) United States Patent
Ludovici

(10) Patent No.: US 10,500,111 B1
(45) Date of Patent: Dec. 10, 2019

(54) FOLDING LATCH MECHANISM WITH MULTIPLE LATCH POSITIONS

(71) Applicant: Ki Mobility LLC, Stevens Point, WI (US)

(72) Inventor: Alan Ludovici, Stevens Point, WI (US)

(73) Assignee: Ki Mobility LLC, Stevens Point, WI (US)

( * ) Notice: Subject to any disclaimer, the term of this patent is extended or adjusted under 35 U.S.C. 154(b) by 111 days.

(21) Appl. No.: 15/802,199

(22) Filed: Nov. 2, 2017

(51) Int. Cl.
*A61G 5/08* (2006.01)
*A61G 5/10* (2006.01)

(52) U.S. Cl.
CPC ..... *A61G 5/0883* (2016.11); *A61G 5/0866* (2016.11); *A61G 5/1067* (2013.01)

(58) Field of Classification Search
CPC ... A61G 5/0883; A61G 8/0866; A61G 5/1067
USPC ..... 297/354.12, 378.1–378.12, DIG. 4
See application file for complete search history.

(56) References Cited

U.S. PATENT DOCUMENTS 8,002,354 B2 * 8/2011 Chen ..... A47C 3/16 297/378.1
2004/0239169 A1 * 12/2004 De Nichilo ..... B60N 2/206 297/378.12

* cited by examiner

*Primary Examiner* — Syed A Islam
(74) *Attorney, Agent, or Firm* — Thedford I. Hitaffer; Hitaffer & Hitaffer, PLLC

(57) ABSTRACT

A latch mechanism for wheelchair seatbacks has multiple latch positions. The latch mechanism comprises a latch plate for supporting the back cane. The latch plate comprises a first relief and a second relief spaced from the first relief. A pivot pin is provided between the first and second reliefs for supporting the latch plate for pivotal movement in relation to the seat rail. A first catch is supported in relation to the latch plate for releasably engaging the first relief upon pivoting the latch plate in a first direction to lower the back cane to a folded position. A second catch is supported in relation to the latch plate for releasably engaging the second relief upon pivoting the latch plate in a second direction to raise the back cane to an unfolded position. The first and second catches are positioned with the latch plate therebetween.

14 Claims, 6 Drawing Sheets

FOLDING LATCH MECHANISM WITH MULTIPLE LATCH POSITIONS

BACKGROUND OF THE INVENTION

This invention relates in general to wheelchairs and more particularly, to a latch mechanism for wheelchair seatbacks. Most particularly, the invention relates to a seatback folding latch mechanism with multiple latch positions.

Wheelchairs are well known, as are folding wheelchairs, which fold into a compact structure for transportation and storage. Such wheelchairs often include a base frame, which is foldable. The base frame comprises or supports opposingly disposed seat rails for supporting a seat (e.g., a seat panel, sling or the like) therebetween. Opposing back canes are typically supported in relation to respective seat rails. The back canes support a seatback therebetween. The back canes are supported for pivotal movement in relation to the back canes, to permit adjustment in the angle of the seatback, and permit the back canes, and the seatback supported thereby, to be folded to a position for transportation and storage. Often, wheelchair features (e.g., side guards, etc.) interfere with back canes, when being folded in the folded position. The back canes can often be latched in a raised position, for supporting an occupant of the wheelchair. However, known latch mechanisms are somewhat complex and have limited functionality. Moreover, such latch mechanisms generally provide no adjustment in the back canes in the raised position. Additionally, wheelchairs often do not have a mechanism for latching the back canes in the folded position, or comprise a separate latch mechanism that is independent of the mechanism for latching the back canes in the raised position. What is needed is a latch mechanism with greater functionality, means for adjustment and ease of use.

SUMMARY OF THE INVENTION

This invention relates to a latch mechanism for wheelchair seatbacks. The seatback folding latch mechanism has multiple latch positions. The latch mechanism comprises a latch plate for supporting the back cane. The latch plate comprises a first relief and a second relief spaced from the first relief. A pivot pin is provided between the first and second reliefs for supporting the latch plate for pivotal movement in relation to the seat rail. A first catch is supported in relation to the latch plate for releasably engaging the first relief upon pivoting the latch plate in a first direction to lower the back cane to a folded position. A second catch is supported in relation to the latch plate for releasably engaging the second relief upon pivoting the latch plate in a second direction to raise the back cane to an unfolded position. The first and second catches are positioned with the latch plate therebetween.

Various advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
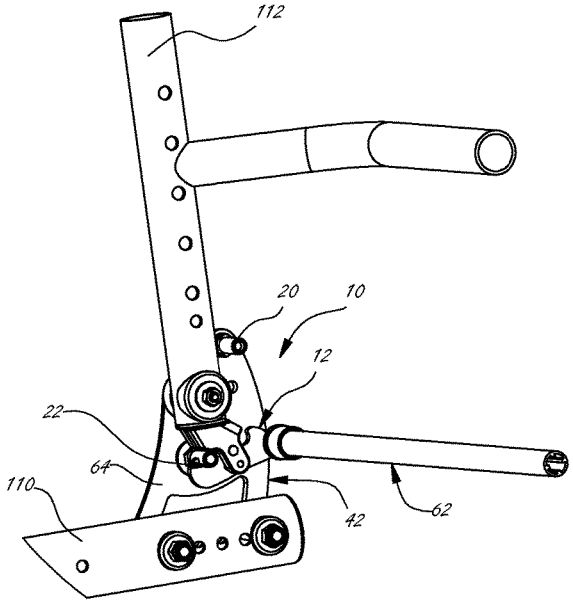
FIG. 1 is a front perspective view of relevant portions of a wheelchair, showing a back cane supported in relation to a seat rail by a latch mechanism according to the invention.
Figure 2:
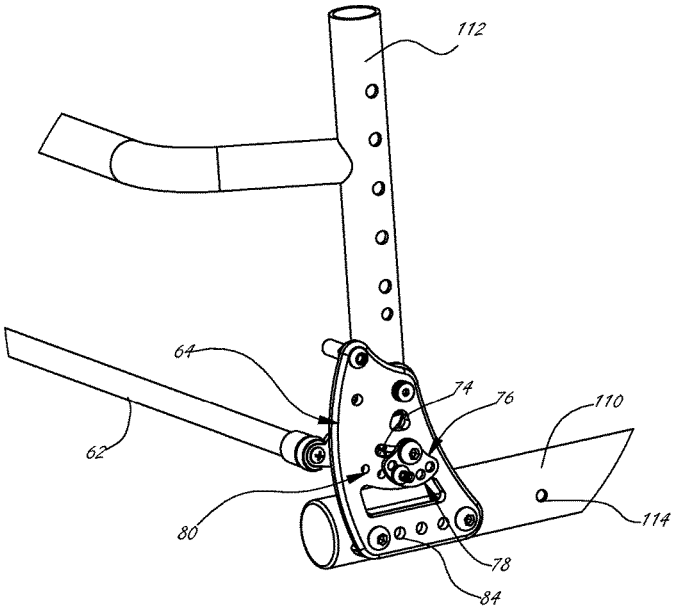
FIG. 2 is a rear perspective view of the wheelchair portion and latch mechanism shown in FIG. 1.
Figure 10:
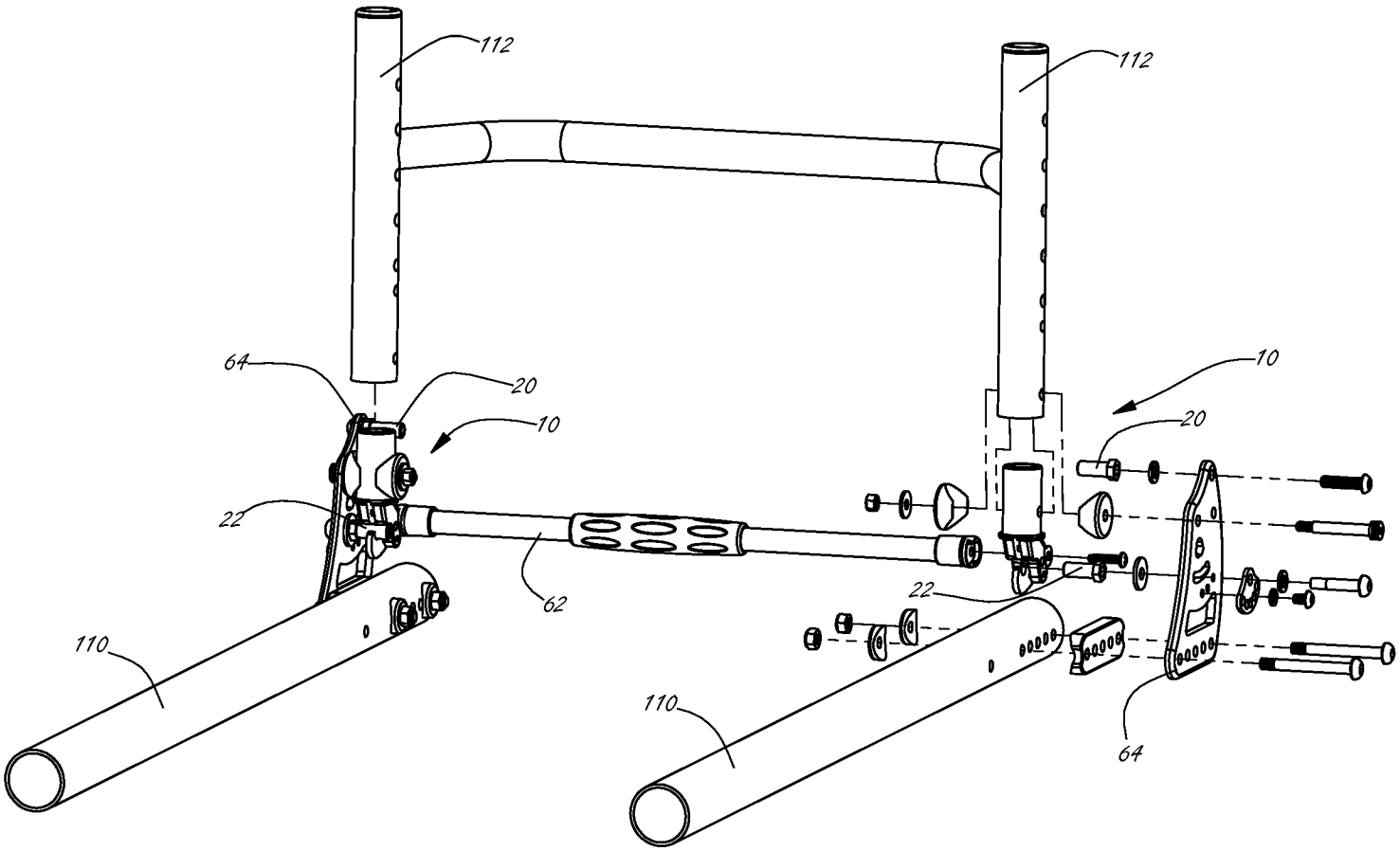
FIG. 10 is a front perspective view of relevant portions of a wheelchair, showing laterally spaced back canes supported in relation to corresponding seat rails by corresponding latch mechanisms according to the invention.

Referring now to the drawings, there is illustrated in FIGS. 1 and 2 a seat rail 110 for a wheelchair (not shown). Although a single seat rail 110 is shown, it should be understood that a wheelchair according to the invention would be comprised of two laterally spaced, or opposingly disposed, seat rails 110 for supporting a seat (e.g., a seat panel, sling or the like) therebetween (as shown in FIG. 10). To simplify the description and provide a clear view of the invention, the seat is not shown. A back cane 112 is supported in relation to each seat rail 110. A seatback (not shown) spans laterally between and is supported in relation to the back canes 112. The back canes 112 are supported for pivotal movement in relation to respective seat rails 110. As will become apparent in the description that follows, a latch mechanism, generally at 10 when viewing the drawings, is provided for holding the back canes 112 in a first or lowered or folded position (e.g., a position parallel or substantially parallel to the seat rails 110, as shown in FIG. 7), for transportation and storage of the wheelchair, and a second or raised or unfolded position (as shown in FIG. 8), for supporting a user or occupant when in use.

Figure 3:
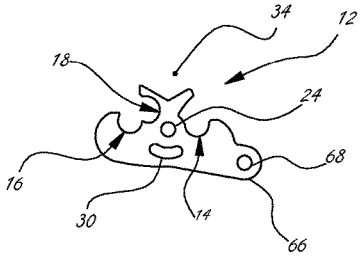
FIG. 3 is a slightly enlarged view of a latch plate of the latch mechanism shown in FIGS. 1 and 2.
Figure 7:
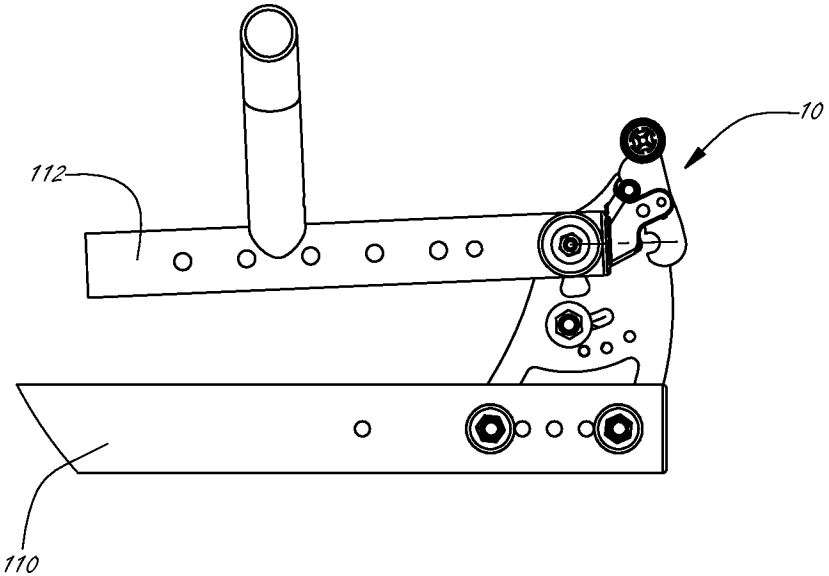
FIG. 7 is an enlarged side elevational view of the wheelchair portions and latch mechanism shown in FIG. 1, with a back cane thereof in a lowered, folded position.
Figure 8:
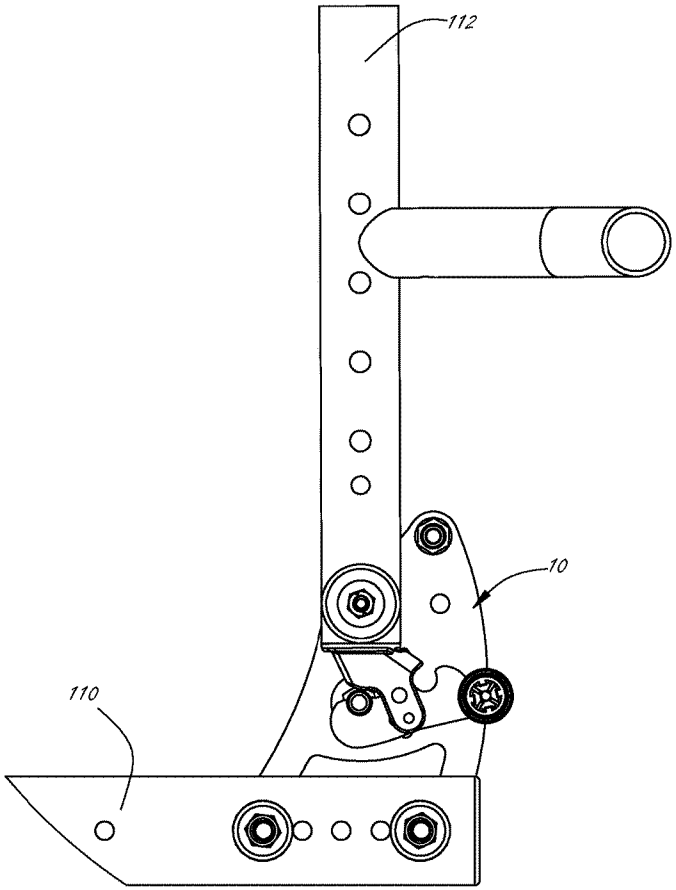
FIG. 8 is a side elevational view of the wheelchair portions and latch mechanism shown in FIG. 7, with a back cane thereof in a raised, unfolded position.
Figure 9:
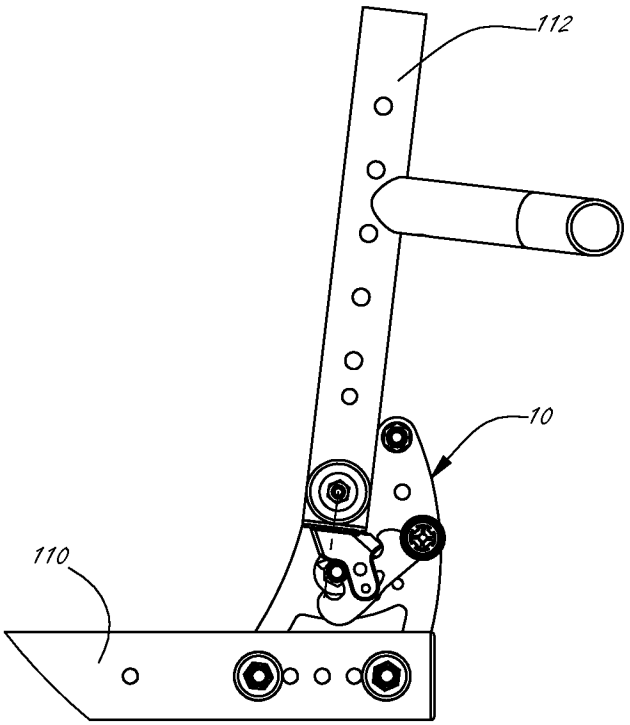
FIG. 9 is a reduced scale side elevational view of the wheelchair portions and latch mechanism shown in FIG. 8, with a back cane thereof in a recline position.

As shown in FIG. 3, and further, with continued reference to FIGS. 1 and 2, in accordance with the illustrated embodiment, the latch mechanism 10 comprises a latch plate 12, which enables the back canes 112 to latch in a plurality of latch positions, including the first position (i.e., horizontal or substantially horizontal when viewing the drawings, shown in FIG. 7), the second position (i.e., vertical or substantially vertical when viewing the drawings, shown in FIG. 8), a third position (i.e., a recline latch position, shown in FIG. 9). In an exemplary embodiment, the back canes 112 recline in a six degree recline position (e.g., six degrees from a vertical or adjusted vertical position). These three positions are represented by three corresponding reliefs, grooves, holes or cutouts 14, 16, 18 (e.g., in the perimeter of the plate), which cooperate with a suitable catch 20, 22 (shown in FIG. 1) supported in fixed relation to the latch plate 12. The latch plate 12 is supported for pivotal movement in relation to the back canes 112, which are supported for pivotal movement in relation to the catches 20, 22. In the illustrated embodiment, two mechanical catches 20, 22 (e.g., spaced round barrels) selectively cooperate with corresponding cutouts 14, 16, 18 in the latch plate 12. A first catch 20 (i.e., an upper catch structure when viewing the drawings) is positioned to cooperate with a first cutout 14 in the latch plate 12, when the back cane 112 is in the first position. A second catch 22 (i.e., a lower catch structure when viewing the drawings) is positioned to cooperate with second and third cutouts 16, 18 in the latch plate 12, when the back cane 112 is in the second or third positions. The second and third cutouts 16, 18 overlap or communicate with one another to allow the back canes 112 to readily move between the second and third positions.

Figure 6:
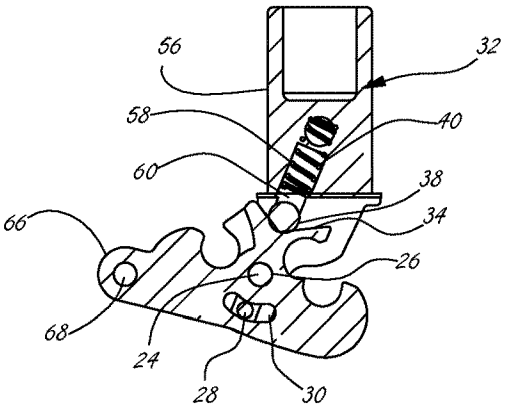
FIG. 6 is a cross-sectional view of the latch mechanism taken along the line 6-6 in FIG. 5.
Figure 5:
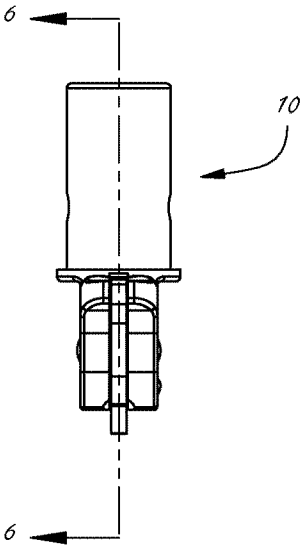
FIG. 5 is a front plan view of the latch mechanism shown in FIG. 4.
Figure 4:
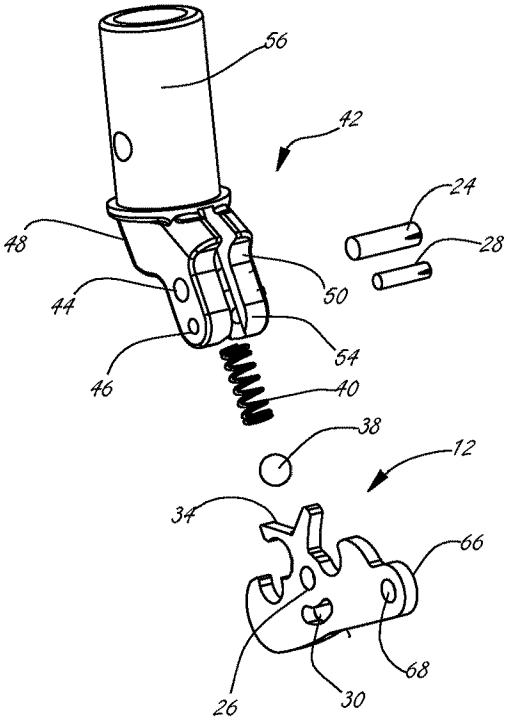
FIG. 4 is an enlarged, exploded front perspective view of the latch mechanism according to the invention.

The latch plate 12 is moveable in relation to the seat rail 110 via a pivot pin 24, which cooperates with a pivot pin hole 26 passing through the latch plate 12 between the first cutout 14 and the second and third cutouts 16, 18, as shown in FIGS. 4-6. The illustrated pivot hole 26 is positioned approximately equidistantly between the first cutout 14 and the second and third cutouts 16, 18. The pivot pin 24 is supported in a fixed position in relation to the back cane 112.

Travel (i.e., pivotal movement) of the latch plate 12 is limited by a travel pin 28, which cooperates with a travel slot 30 in the latch plate 12. In the illustrated embodiment, the travel slot 30 is an arcuate slot having an arch the focal point of which is coincident with the pivot pin 24. The travel pin 28 is supported in a fixed position in relation to the back cane 112, and in relation to the pivot pin 24.

A perimeter of the latch plate 12 forms a detent surface 34 that cooperates with a detent arrangement 32. In the illustrated embodiment, the detent surface 34 is the V-shaped surface, which is located opposite the travel slot 30 in relation to the pivot pin hole 26. The detent arrangement 32 may be comprised of a spring biased ball assembly, including a detent ball 38, which cooperates with the detent surface 34, and which is biased by a detent spring 40. The travel slot 30 and travel pin 28 and the detent arrangement 32 are arranged and configured so that the detent arrangement 32 biases the latch plate 12 so as to center the travel pin 28 in the travel slot 30.

The latch plate 12 may be supported for pivotal movement in relation to the back canes 112 in any suitable manner. In the illustrated embodiment, this support is provided by a yoke 42. The yoke 42 has a first or pivot pin hole 44 for supporting the pivot pin 24 and a second or travel pin hole 46 for supporting the travel pin 28. Of course, these holes 44, 46 align correspondingly with the pivot pin hole 26 and travel slot 30 in the latch plate 12.

The yoke 42 has two surfaces 48, 50 that correspondingly cooperate with the two cutouts 14, 16 to capture the catches 20, 22 in corresponding cutouts 14, 16, as will become apparent in the description that follows. The yoke 42 extends from, or is otherwise supported in relation to, a barrel or plug 56, or other suitable structure, which is dimensioned and configured to cooperate with the back canes 112, so as to be supported in fixed relation to the back canes 112. In the illustrated embodiment, the plug 56 is provided with a spring hole 58, which is coincident with a spring hole 60 in an interface member (shown but not referenced) of the yoke 42, wherein the coincident spring holes 58, 60 support the detent spring 40, and wherein the spring hole 60 in the interface member of the yoke 42 supports or carries the detent ball 38 for movement by force of the detent spring 40. The spring holes 58, 60 are angled so as to be linearly aligned with legs 54 of the yoke 42, which support the pivot pin 24 and the travel pin 28 in linear alignment with the detent spring 40 and the detent ball 38. As should be clearly understood, cylindrical spring holes may be provided for supporting or carrying a helical spring.

The plug 56 is provided with an aperture that corresponds with an aperture (shown but not referenced in FIG. 10) in an end of the back cane 112 (i.e., a lower end when viewing the drawings). A fastener (shown but not referenced in FIG. 10) passes through the apertures to couple or hold the plug 56 (shown in FIGS. 4 and 5) in fixed relation to the back cane 112. The fastener is supported in a fixed position in relation to the back cane 112, and is held in relation to the apertures for pivotal movement therein so that the fastener functions as a pivot pin for the back canes 112.

It should be appreciated that, as the back cane 112 is pivoted about the fastener, the latch mechanism 10 (i.e., generally, the latch plate 12 and the yoke 42) orbits about the fastener, or move along an arcuate path, the focal point of which is coincident with an axis defined by the fastener. The first and second catches 20, 22 are positioned in fixed relation about the fastener, so that upon pivoting the back cane 112 down into the first or folded or horizontal position, the first catch 20 engages the first cutout 14, and upon pivoting the back cane 112 up into the second or unfolded or vertical or adjusted vertical position, the second catch 22 engages the second cutout 16. The catches 20, 22 cam on corresponding yoke surfaces 48, 50 and latch plate perimeter surfaces adjacent corresponding cutouts 14, 16 to bias the latch plate 12 against the force of the detent spring 40 to allow a catch 20, 22 to enter into a corresponding cutout 14, 16, and subsequently return the latch plate 12 back to a centered position, wherein the travel pin 28 is centered in the travel slot 30, wherein the catch 20, 22 is captured in a corresponding cutout 14, 16. The catch 20, 22 may be released from the corresponding cutout 14, 16 by toggling the latch plate 12 (i.e., forcibly pivoting the latch plate 12 against the force of the detent spring 40).

It should be clear that the latch mechanism 10 is a double latch mechanism, which when pivoted in a first direction to a folded position, the first catch 20 engages the first cutout 14, and when pivoted in a second direction to an unfolded position, the second catch 22 engages the second cutout 16.

As mentioned above, latch mechanisms 10 may be provided on each or opposing sides of a wheelchair, as shown in FIG. 10. To release a catch 20, 22 of each of the latch mechanisms 10 at once, or simultaneously, (e.g., through an operation of a single control), a suitable control structure may extend between and connect the two latch mechanisms 10. In the illustrated embodiment, a backrest release bar 62 is provided (e.g., for single-handed operation). The backrest release bar 62 may be connected to the two latch mechanisms 10 in any suitable manner. For example, an ear, tab, or other suitable structure 66, may extend from the latch plate 12. The ear 66 may be provided with a through hole 68, through which a fastener 70 may pass. The fastener 70 may be a threaded fastener, which may thread into a threaded aperture (shown but not referenced) in an end of the backrest release bar 62. Pushing down or lifting up on the backrest release bar 62 displaces or pivotally moves the latch plate 12 to release the catch 20, 22 from the corresponding cutout 14, 16.

It should be appreciated that latch mechanisms 10 according to the invention may be supported in relation to the seat rail 110, or other suitable feature of the wheelchair (e.g., some feature of the wheelchair base frame), and the back cane 112. In the illustrated embodiment, latch mechanisms 10, together with the catches 20, 22, are supported in relation to the seat rail 110 and the back cane 112 by corresponding mounting bracket or plates 64, using as needed, suitable hardware (e.g., saddles and saddle backs, washers, fasteners, including threaded fasteners, such as screws, bolts and nuts) (shown but not referenced).

As stated above, the second and third cutouts 16, 18 overlap, or in communication, with each other. This allows the second catch 22 to move between the second and third cutouts 16, 18 as an occupant moves or leans back against the seatback to a recline position (shown in FIG. 9). As an occupant moves or leans back against the seatback to a recline position, the second catch 22 moves to the third cutout 18. As the occupant moves forward towards an upright or non-recline position, the detent arrangement 32 urges the latch plate 12 back to the centered position (i.e., with the travel pin 28 centered in the travel slot 30), which urges the second catch 22 back to the second cutout 16, urging the seatback to an upright or vertical, or non-recline position.

It should be appreciated that the back canes 112 may be adjustable to provide adjustment to meet an occupant's needs. For example, the position of the second catch 22 may be adjusted to adjust the upright or vertical orientation of the back canes 112 (or some adjusted angle from vertical) as needed or desired by the user or occupant. This may be accomplished in any suitable manner. In the embodiment illustrated in FIGS. 1 and 2, the second catch 22 is supported for movement along an arcuate slot 74, using, for example, an adjustment plate 76 for supporting the catch 22 via a threaded fastener (shown but not referenced). The adjustment plate 76 has incremental adjustment holes 78. The adjustment plate 76 is adjustable via a threaded fastener (shown but not referenced) that passes through the incremental adjustment holes 78 and threads into select threaded holes 80 in the mounting bracket 64. The threaded holes 80 are arranged along an arcuate path to provide an incremental angular adjustment (e.g., in two-degree increments).

Additionally, the mounting bracket 64 can be adjusted in relation to the seat rail 110, for example, in a fore and aft direction, to adjust the seat depth. Though this can be accomplished in any suitable manner, such adjustment may be accomplished by providing holes 114 arranged incrementally along the length of the seat rail 110, and the mounting bracket 64 may be provided with a plurality of indexed through holes 84, which may be selectively aligned with corresponding holes 114 in the seat rail 110 in the mounting bracket 64, as needed or desired by the user or occupant.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A seatback folding latch mechanism for a wheelchair comprising a seat rail and a back cane for supporting a seatback, the seatback folding latch mechanism comprising:

a latch plate for supporting the back cane, the latch plate comprising a first relief and a second relief spaced from the first relief, a pivot pin between the first and second reliefs supporting the latch plate for pivotal movement in relation to the seat rail, a first catch supported in relation to the latch plate for releasably engaging the first relief upon pivoting the latch plate in a first direction to lower the back cane to a folded position, and a second catch supported in relation to the latch plate for releasably engaging the second relief upon pivoting the latch plate in a second direction to raise the back cane to an unfolded position, wherein the first and second catches are positioned with the latch plate therebetween, wherein the latch plate comprises a third relief in communication with the second relief, wherein the second catch is moveable between the second relief and the third relief to permit movement of the back cane from the unfolded position to a recline position.

2. The seatback folding latch mechanism of claim 1, wherein the second and third reliefs are positioned to permit the back cane to move six degrees from the unfolded position.

3. A seatback folding latch mechanism for a wheelchair comprising a seat rail and a back cane for supporting a seatback, the seatback folding latch mechanism comprising:

a latch plate for supporting the back cane, the latch plate comprising a first relief and a second relief spaced from the first relief, a pivot pin between the first and second reliefs supporting the latch plate for pivotal movement in relation to the seat rail, a first catch supported in relation to the latch plate for releasably engaging the first relief upon pivoting the latch plate in a first direction to lower the back cane to a folded position, and a second catch supported in relation to the latch plate for releasably engaging the second relief upon pivoting the latch plate in a second direction to raise the back cane to an unfolded position, wherein the first and second catches are positioned with the latch plate therebetween, wherein the second catch is selectively supported in one of a plurality of support positions in relation to the latch plate to permit an angle of the back cane to be adjusted in the unfolded position.

4. The seatback folding latch mechanism of claim 3, wherein the support positions are arranged to permit the unfolded position of the back cane to be adjusted in two-degree increments.

5. A seatback folding latch mechanism for a wheelchair comprising a seat rail and a back cane for supporting a seatback, the seatback folding latch mechanism comprising:

a latch plate for supporting the back cane, the latch plate comprising a first relief and a second relief spaced from the first relief, a pivot pin between the first and second reliefs supporting the latch plate for pivotal movement in relation to the seat rail, a first catch supported in relation to the latch plate for releasably engaging the first relief upon pivoting the latch plate in a first direction to lower the back cane to a folded position, and a second catch supported in relation to the latch plate for releasably engaging the second relief upon pivoting the latch plate in a second direction to raise the back cane to an unfolded position, wherein the first and second catches are positioned with the latch plate therebetween, wherein the pivotal movement of the latch plate is limited by a travel pin, which cooperates with a travel slot in the latch plate.

6. The seatback folding latch mechanism of claim 5, wherein the latch plate further comprises a detent surface located to one side of the pivot pin opposite the travel slot and with the first and second reliefs in opposing directions thereof, and wherein a detent arrangement comprises a spring biased ball assembly, including a detent ball, which cooperates with the detent surface, and which is biased by a detent spring to center movement of the travel pin in the travel slot.

7. The seatback folding latch mechanism of claim 6, further comprising a yoke having a pivot pin hole for supporting the pivot pin and a travel pin hole for supporting the travel pin, the pivot pin hole and the travel pin hole aligning correspondingly with a pivot pin hole in the latch plate and the travel slot in the latch plate.

8. The seatback folding latch mechanism of claim 7, wherein the yoke has two surfaces that correspondingly cooperate with the reliefs to capture the catches upon pivotal movement of the latch plate.

9. The seatback folding latch mechanism of claim 7, wherein the yoke extends from a plug that cooperates with the back cane to be supported in fixed relation to the back cane.

10. The seatback folding latch mechanism of claim 7, wherein the yoke comprises legs that support the latch plate for pivotal movement therebetween.

11. The seatback folding latch mechanism of claim 7, wherein the latch plate and the yoke orbit about a pivot axis of the back cane.

12. A seatback folding latch mechanism for a wheelchair comprising a seat rail and a back cane for supporting a seatback, the seatback folding latch mechanism comprising:

a latch plate for supporting the back cane, the latch plate comprising a first relief and a second relief spaced from the first relief, a pivot pin between the first and second reliefs supporting the latch plate for pivotal movement in relation to the seat rail, a first catch supported in relation to the latch plate for releasably engaging the first relief upon pivoting the latch plate in a first direction to lower the back cane to a folded position, and a second catch supported in relation to the latch plate for releasably engaging the second relief upon pivoting the latch plate in a second direction to raise the back cane to an unfolded position, wherein the first and second catches are positioned with the latch plate therebetween, wherein the latch mechanism, together with the catches, are supported in relation to the seat rail and the back cane by a mounting bracket, wherein the mounting bracket is supported in relation to the seat rail.

13. The seatback folding latch mechanism of claim 12, wherein the mounting bracket is adjustable in fore and aft directions in relation to the seat rail to provide seat depth adjustment.

14. A seatback folding latch mechanism for a wheelchair comprising a seat rail and a back cane for supporting a seatback, the seatback folding latch mechanism comprising:

a latch plate for supporting the back cane, the latch plate comprising a first relief and a second relief spaced from the first relief, a pivot pin between the first and second reliefs supporting the latch plate for pivotal movement in relation to the seat rail, a first catch supported in relation to the latch plate for releasably engaging the first relief upon pivoting the latch plate in a first direction to lower the back cane to a folded position, and a second catch supported in relation to the latch plate for releasably engaging the second relief upon pivoting the latch plate in a second direction to raise the back cane to an unfolded position, wherein the first and second catches are positioned with the latch plate therebetween, wherein the seat rail is one of two laterally spaced seat rails and the back cane is one of two laterally spaced back canes, the seatback folding latch mechanism being one of two seatback folding latch mechanisms each supported in relation to a corresponding one of the seat rails and supporting a corresponding one of the back canes, wherein a release bar connects the two mechanisms for controlling single-handedly the seatback folding latch mechanisms to release simultaneously the first and second catches from the first and second reliefs, respectively.

* * * * *